US006599868B2

(12) United States Patent
Dunn et al.

(10) Patent No.: US 6,599,868 B2
(45) Date of Patent: Jul. 29, 2003

(54) LUBRICATING OIL COMPOSITIONS

(75) Inventors: Adrian Dunn, Oxon (GB); Alan Aries, Oxon (GB); Neil E. Briffett, Singapore (SG)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/975,611

(22) Filed: Oct. 11, 2001

(65) Prior Publication Data

US 2002/0128160 A1 Sep. 12, 2002

(30) Foreign Application Priority Data

Oct. 13, 2000 (EP) ..... 00203541

(51) Int. Cl.[7] ..... C10M 129/72
(52) U.S. Cl. ..... 508/482
(58) Field of Search ..... 508/482

(56) References Cited

U.S. PATENT DOCUMENTS

| | | | | | |
|---|---|---|---|---|---|
| 2,956,870 | A | | 10/1960 | Heisler et al. | 44/389 |
| 3,637,500 | A | * | 1/1972 | Forbes et al. | 508/482 |
| 3,941,910 | A | * | 3/1976 | Asano et al. | 428/457 |
| 3,951,977 | A | | 4/1976 | Plasek et al. | 544/373 |
| 4,370,247 | A | * | 1/1983 | Ostyn | 508/359 |
| 4,723,965 | A | | 2/1988 | Yoshida et al. | 44/398 |
| 4,790,957 | A | * | 12/1988 | Mach et al. | 508/482 |
| 5,019,286 | A | * | 5/1991 | Shaw et al. | 508/462 |
| 5,405,418 | A | | 4/1995 | Ansarie et al. | 44/389 |
| 5,516,443 | A | | 5/1996 | Jackson et al. | 508/515 |
| 5,580,483 | A | * | 12/1996 | Hamid | 508/480 |
| 6,235,691 | B1 | * | 5/2001 | Boffa et al. | 508/482 |
| 6,277,794 | B1 | * | 8/2001 | Dunn | 508/199 |
| 6,339,051 | B1 | * | 1/2002 | Carey et al. | 508/391 |

FOREIGN PATENT DOCUMENTS

| | | |
|---|---|---|
| DE | 1038688 | 11/1958 |
| EP | 0731158 | 11/1996 |

* cited by examiner

*Primary Examiner*—Ellen M. McAvoy

(57) ABSTRACT

A marine engine lubricating oil composition for a slow or medium speed diesel engine comprises a major amount of an oil of lubricating viscosity that contains a minor amount of a fuel oil with a residual fuel content and, admixed therewith, a minor amount of at least one oil-soluble or oil-dispersible ashless organic compound having at least two adjacent, substitutable carbon atoms being either part of an aromatic moiety or being connected by a double bond, each carrying an O— or O— and N-containing functional group, both groups being derived from a carboxy group.

12 Claims, No Drawings

LUBRICATING OIL COMPOSITIONS

This invention relates to lubricating oil compositions exhibiting improved crankcase cleanliness, particularly lubricating oil compositions suitable for engines which burn fuel containing asphaltene components, such as medium or slow speed diesel engines, such as 4-stroke trunk piston or 2-stroke cross-head marine engines.

Manufacturers commonly design marine diesel engines to use a variety of diesel fuels, ranging from good quality light distillate fuel with low sulfur and asphaltene content to poorer quality intermediate or heavy fuel such as "Bunker C" or residual fuel oil with generally higher sulfur and asphaltene content. Lubricants used in such engines are often contaminated with asphaltene components from the fuel. This leads to severe engine cleanliness problems in service (sometimes referred to as "black paint"), a problem which is particularly widespread in 4-stroke trunk piston engines where dirty cam boxes, deposits in piston scraper rings and sludge coatings on crankcase walls are found. Further, the lubricant handling system, for example, the heaters, filters and centrifuges, may function less well. The problem is not confined to 4-stroke engines; 2-stroke cross-head engines can also be affected.

EP-A-0662,508 and EP-A-0 708 171 describe ways of dealing with the above problem, but using compounds that contain metal salts. This constitutes a problem in view of industry trends and needs towards using lubricating oil compositions with reduced ash, ie low metal, content.

EP-A-0731,158 describes a lubricating oil composition suitable for use in low or medium speed diesel engines comprising a fuel oil with a residual oil content characterised in that the lubricating oil composition further comprises a "black paint" reducing amount of the product obtained by the reaction at elevated temperature of a hydrocarbyl-substituted succinic anhydride with either serine or an aminosalicylic acid. Such products are imides with free carboxy and hydroxy groups, eg, in the case of the aminosalicylic acid derivative, made as described in U.S. Pat. No. 5,266,081.

The present invention provides a way of solving the above problem using an ash-free chemistry and one that is remote from that described in EP-A-0 731 158, and that enables formulators to improve the cost-effectiveness of their lubricants, It has now been found that compounds having a certain structural feature are able to effectively suspend asphaltenes in marine lubricating oil compositions and thereby improve crankcase cleanliness.

Accordingly, a first aspect of the present invention is a marine engine lubricating oil composition for a slow or medium speed diesel engine comprising a major amount of an oil of lubricating viscosity that contains a minor amount of a fuel oil with a residual fuel content and, admixed therewith, a minor amount of at least one oil-soluble or oil-dispersible ashless organic compound having at least two adjacent, substitutable carbon atoms being either part of an aromatic moiety or being connected by a double bond, each of said carbon atoms carrying an O— or O— and N-containing functional group, both groups being derived from a carboxy group.

A second aspect of the invention is the use of the compound defined in the first aspect in a lubricating oil composition to suspend asphaltene components in the composition when used in a slow or medium speed diesel engine, such as a cross-head or trunk piston engine.

A third aspect of the invention is a method of lubricating a slow or medium speed diesel engine, such as a cross-head or trunk piston engine, comprising supplying to the engine the lubricating oil composition of either the first or second aspects.

The features of the invention will now be discussed in more detail.

Marine Engines

The lubricating oil compositions of the present invention may be suitable for use in a 4-stroke trunk piston diesel engine such as having an engine speed of 200 to 2,000, e.g. 400 to 1,000, rpm, and a brake horse-power (BHP) per cylinder of 50 to 3,000 preferably 100 to 2,000. It may also be suitable for use in a 2-stroke cross-head diesel engine such as having a speed of 40 to 200, preferably 60 to 120, rpm and a BHP per cylinder of 500 to 10,000. Engines used for auxiliary power generation applications or in land-based power generation applications are also suitable. Preferably, the engine is a 4-stroke trunk piston diesel engine. As used herein, "slow speed diesel engine" refers to a 2-stroke cross-head diesel engine, and "medium speed diesel engine" refers to a 4-stroke trunk piston diesel engine.

Lubricating Oil

The oil of lubricating viscosity (sometimes referred to as lubricating oil) may be any oil suitable for the lubrication of a cross-head engine or a trunk piston engine. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example liquid polyisobutene and poly-alpha olefins. Commonly, a mineral oil is employed. The lubricating oil may generally comprise greater than 60, typically greater than 70, mass % of the composition, and typically have a kinematic viscosity at 100° C. of from 2 to 40, for example from 3 to 15, $mm^2s^{-1-}$, and a viscosity index of from 80 to 100, for example from 90 to 95.

Another class of lubricating oils is hydrocracked oils, where the refining process further breaks down the middle and heavy distillate fractions in the presence of hydrogen at high temperatures and moderate pressures. Hydrocracked oils typically have kinematic viscosity at 100° C. of from 2 to 40, for example from 3 to 15, $mm^2s^{-1}$ and a viscosity index typically in the range of from 100 to 110, for example from 105 to 108.

Base oils which are solvent-extracted, de-asphalted products from vacuum residuum generally having a kinematic viscosity at 100° C. of from 28 to 36 $mm^2s^{-1}$ are also suitable for use in the present invention. They are typically used in a proportion of less than 30, preferably less than 20, more preferably less than 15, most preferably less than 10, such as less than 5, mass %, based on the mass of the composition.

Ashless Compounds

The compounds of the present invention are ashless organic compounds, that is they do not contain any metals and, after combustion leave little or no ash.

Adjacent, substitutable carbon atoms refers to carbon atoms that can carry a substituent comprising a functional group and that are either bonded directly to one another as members of a chain or a ring, or are bonded via an unsubstitutable bridge atom.

Without wishing to be bound by any theory, it is believed that the significance of the adjacent carbon atoms is that they enable the compound to chelate, thereby increasing its ability to dissolve those contaminants present in residual fuel. Also, the significance of the presence of O and/N atoms, where present, on the functional groups is to facilitate interaction with O— and N-based functionalities known to be present on the surface of ashphaltenes.

The aromatic moiety, when employed, may be a hydrocarbon or may include in its ring or rings atoms other than carbon and hydrogen such as one or more of oxygen, nitrogen and sulfur. The moiety may be monocyclic or polycyclic, including fused polycyclic. Preferred examples of the aromatic moiety are benzene, when the functional groups are in the ortho position with respect to one another, and naphthalene, when the functional groups are in the 1- and 8-positions respectively.

The functional groups may, for example, be ester groups. The functional groups may carry hydrocarbyl groups which preferably contain from 1 to 20, such as 1 to 16, such as 2 to 10, carbon atoms. The hydrocarbyl group may be aryl, alkyl or alkylaryl group. Preferably the hydrocarbyl group is an alkyl group which may be straight or branched.

Thus, advantageously, at least one, preferably both, of the functional groups is an ester group, COOR, where R is an alkyl group as defined above.

Especially preferred ashless organic compounds are phthalate esters. Phthalate esters have been found to be particularly effective in suspending asphaltene components when used in a slow or medium speed diesel engine. Suitable examples of phthalate esters, which include mono- and di-esters, contain 1 to 20, such as 1 to 10, preferably 2 to 10, carbon atoms on the alkyl group. The alkyl group of the ester may be straight or branched. The esters may have viscosity properties similar to those of lubricating oils described above; they may then be introduced into the lubricating oil compositions of the present invention as part of the lubricating oil. When phthalate esters are used, they are preferably present in an amount greater than 2, such as greater than 4, advantageously greater than 5, mass % based on the mass of the composition.

Hydrocarbyl, as used herein, refers to a substituent having a carbon atom directly attached to the remainder of the substituent and is predominantly hydrocarbyl in character within the context of this invention.

The oil-soluble or oil-dispersible ashless compounds can be prepared by methods known in the art.

The terms 'oil-soluble' or 'oil-dispersible' as used herein do not necessarily indicate that the compounds or additives are soluble, dissolvable, miscible or capable of being suspended in the oil in all proportions. They do mean, however, that they are, for instance, soluble or stably dispersible in oil to an extent sufficient to exert their intended effect in the environment in which the oil is employed. Moreover, the additional incorporation of other additives may also permit incorporation of higher levels of a particular compound or additive, if desired.

Lubricating Oil Composition

The lubricating oil composition preferably has a TBN of up to 100, such as 15 to 100, more preferably 30 to 60, for example in the range of from 40 to 55. Preferably, the viscosity index of the lubricant composition is at least 90, more preferably at least 95, and at most 140 such as 120, preferably 110. A preferred viscosity index range is from 95 to 115.

The lubricant composition may, for example, have a kinematic viscosity at 100° C. (as measured by ASTM D445) of at least 9, preferably at least 13, more preferably in the range of from 14 to 24, for example from 14 to 22, $mm^2s^{-1}$.

Fuel oils may be divided into two main categories—distillates and heavy fuels. Distillates consist of one or more distilled fractions. Heavy fuels are fuels which comprise at least a proportion of a residual oil, that is an oil which remains after the distilled fractions have been removed from an unrefined oil. The composition of the residual oil varies with the composition of the starting oil, usually a crude oil, and upon the distillation conditions. However, by its nature, residual oil is of high molecular weight and high boiling point and those skilled in the art will understand what is meant by residual oil. Heavy fuels can also comprise, in addition to residual oil, distillates. However, heavy fuels may comprise at least 90, for example at least 95, typically at least 99, mass % of residual oil. The amount of heavy fuel in the lubricating oil composition may, for example comprise between 0.1 to 25, e.g., 0.1 to 10, especially 0.3 to 5, more especially 0.5 to 3, mass % based on the mass of the lubricating oil composition.

The compounds of the present invention are present in the lubricating oil compositions in an amount sufficient to serve their intended purpose, preferably at least 0.001 mass % (active ingredient) based on the mass of the lubricating oil composition. Advantageously, the compounds are present from 0.001 to 25, especially from 0.01 to 10, more preferably from 0.1 to 10, such as 1 to 7, mass %, based on the mass of the lubricating oil composition.

In relation to all aspects of the invention, lubricating oil compositions comprise defined compounds that may or may not remain the same chemically before and after mixing, and may or may not remain the same chemically during use in the engine. The resulting compounds are also within the scope of the present invention.

Lubricating oil compositions of the present invention may further comprise one or more other lubricating oil additives, such as mentioned hereinafter.

The individual additives may be incorporated into a base stock in any convenient way. Thus, each of the components can be added directly to the base stock by dispersing or dissolving it in the base stock at the desired level of concentration. Such blending may occur at ambient temperature or at an elevated temperature.

Preferably, all the additives except the pour point depressant are blended into a additive package that is subsequently blended into base stock to make finished lubricating oil composition. Use of such additive packages is conventional. The package will typically be formulated to contain the additive(s) in proper amounts to provide the desired concentration in the final formulation when the package is combined with a predetermined amount of base lubricant.

The package is conveniently made by blending at about 60° C.

Among the other additives, there may be mentioned the following:

Ashless dispersants may comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide, The resulting overbased detergent comprises neutralized detergent as the outer layer of a metal base (e.g., carbonate) micelle. Such overbased detergents may have a TBN of 150 or greater, and typically from 250 to 600, such as in the range of from 350 to 450 TBN.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricating oil composition, and mixtures of calcium and/or magnesium with sodium. Particularly convenient metal detergents are neutral and overbased calcium sulfonates having TBN of from 20 to 600 TBN, and neutral and overbased calcium phenates and sulfurized phenates having TBN of from 50 to 600. Especially preferred overbased detergent are those comprising more than one surfactant in the surfactant system, i.e. the detergent comprises surfactants derivable from phenol, sulfonic acid and/or salicylic acid. Such detergents are described in PCT applications WO 97/46643, 97/46644, 97/46645, 97/46646 and 97/46647.

Dihydrocarbyl dithiophosphate metal salts are frequently used as anti-wear and antioxidant agents. The metal may be an alkali or alkaline earth metal, or aluminium, lead, tin, molybdenum, manganese, nickel or copper. The zinc salts are most commonly used in lubricating oil in amounts of 0.1 to 10, preferably 0.2 to 2, mass %, based upon the total mass of the lubricating oil composition, They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors, or antioxidants, reduce the tendency of mineral oils to deteriorate in service, evidence of such deterioration being, for example, the production of varnish-like deposits on metal surfaces and of sludge, and viscosity increase. Suitable oxidation inhibitors include sulfurised alkyl phenols and alkali or alkaline earth metal salts thereof; diphenylamines; phenyl-naphthylamines; and phosphosulfurised or sulfurised hydrocarbons.

Other oxidation inhibitors or antioxidants which may be used in lubricating oil compositions comprise oil-soluble copper compounds. The copper may be blended into the oil as any suitable oil-soluble copper compound. By oil-soluble it is meant that the compound is oil-soluble under normal blending conditions in the oil or additive package. The copper may, for example, be in the form of a copper dihydrocarbyl thio- or dithio-phosphate. Alternatively, the copper may be added as the copper salt of a synthetic or natural carboxylic acid, for example, a $C_8$ to $C_{18}$ fatty acid, an unsaturated acid, or a branched carboxylic acid. Also useful are oil-soluble copper dithiocarbamates, sulphonates, phenates, and acetylacetonates. Examples of particularly useful copper compounds are basic, neutral or acidic copper $Cu^I$ and/or $Cu^{II}$ salts derived from alkenyl succinic acids or anhydrides.

Rust inhibitors selected from the group consisting of non-ionic polyoxyalkylene polyols and esters thereof, polyoxyalkylene phenols, and anionic alkyl sulfonic acids may be used.

Pour point depressants, otherwise known as lube oil flow improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Some of the above-mentioned additives can, as is known in the art, provide a multiplicity of effects.

Preferably the compounds of the present invention are useful in combination with one or more of the co-additives described above in the amounts described in the Table below.

The present invention also provides a marine lubricating oil composition which reduces piston scraper deposits and improves crankcase cleanliness without using high levels of neutral or overbased metal salicylate detergents.

Typical proportions for additives for a TPEO (a trunk piston engine oil) are as follows:

| Additive | Mass % a.i.* (Broad) | Mass % a.i.* (Preferred) |
|---|---|---|
| Detergent(s) | 0.5-12 | 2–8 |
| Dispersant(s) | 0.5-5 | 1–3 |
| Ashless Anti-wear agent(s) | 0.1-1.5 | 0.5–1.3 |
| Oxidation inhibitor | 0.2-2 | 0.5–1.5 |
| Rust inhibitor | 0.03-0.15 | 0.05–0.1 |
| Pour point depressant | 0.03-0.15 | 0.05–0.1 |
| Mineral or synthetic base oil | Balance | Balance |

*Mass % active ingredient based on the final oil.

Typical proportions for additives for a MDCL (a marine diesel cylinder lubricant) are as follows:

| Additive | Mass % a.i.* (Broad) | Mass % a.i.* (Preferred) |
|---|---|---|
| Detergent(s) | 1–20 | 3–15 |
| Dispersant(s) | 0.5–5 | 1–3 |
| Ashless Anti-wear agent(s) | 0.1–1.5 | 0.5–1.3 |
| Pour point depressant | 0.03–0.15 | 0.05–0.1 |
| Mineral or synthetic base oil | Balance | Balance |

*Mass % active ingredient based on the final oil.

When a plurality of additives is employed it may be desirable, although not essential, to prepare one or more additive packages comprising the additives, whereby several additives can be added simultaneously to the base oil to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function, in the final formulation when the additive package(s) is/are combined with a predetermined amount of base lubricant. Thus, compounds in accordance with the present invention may be admixed with small amounts of base oil or other compatible solvents together with other desirable additives to form additive packages containing active ingredients in an amount, based on the additive package, of, for example, from 2.5 to 90, and preferably from 5 to 75, and most preferably from 8 to 60, mass % of additives in the appropriate proportions, the remainder being base oil.

The final formulations may typically contain about 5 to 40 mass % of the additive package(s), the remainder being base oil.

If desired, the oil-soluble or oil-dispersible ashless organic compounds of this invention may be provided when incorporated into overbased metal detergents. Such metal detergents comprise a base, such as calcium carbonate, that is held in colloidal dispersion in an oleaginous medium by one or more surfactants such as a phenate, sulfonate, salicylate, or naphthenate, and are discussed in detail in this specification.

Incorporation of an ashless organic compound of this invention into an overbased metal detergent may be effected during preparation of the detergent, by using the compound as a process liquid, for example as described below. A slurry of basic oxide (hydroxide), surfactant, polar solvents and hydrocarbon solvents is carbonated by means of $CO_2$ to convert the hydroxide into dispersed colloidal carbonate; the ashless organic compound is added and solvents are stripped; subsequent filtration gives the final detergent product incorporating the ashless organic compound.

EXAMPLES

The present invention is illustrated by, but in no way limited by, the following examples.

Lubricant Samples

Trunk piston engine oil lubricants were blended to consist of base lubricant oil (90 mass %) and test ester (10 mass %). Samples 1 to 5, containing different phthalate esters, were prepared. Also tested was a comparison sample, sample A, in the form of a commercially available, salicylate-ester containing, lubricant known to dissolve residual fuel.

Test Procedure

The ability of the lubricating oil compositions, or lubricants, of the present invention to dissolve residual fuel was measured in accordance with the following procedure.

Residual fuel (10 mass %) was blended at 60° C. into a test lubricant sample, the resulting blend filtered under vacuum onto a filter paper, and the light transmitted through the filter paper measured using a Bosch lightmeter. Measurements were taken at the centre of the paper (referred to as A) and at four perimeter positions: 0, 90, 180 and 270 degrees on the filter paper (their average being referred to as B). The measurements are expressed as scale units of the light meter on a scale of 0.1 to 10, and reported as A-B. The light transmitted was compared with a control; the reduction in transmitted light arises from deposits collected on the filter paper and provides an indication of the ability of the test lubricant to dissolve the fuel: the lower the reduction, the greater is the fuel dissolving ability.

Results

These are summarised below:

| SAMPLE | ESTER | A | B | A-B |
|---|---|---|---|---|
| BASE | | 8.2 | 4.975 | 3.225 |
| 1 | Dinonyl phthalate (JAYFLEX DINP) | 3.2 | 1.975 | 1.225 |
| 2 | Dihepthyl phthalate (JAYLFEX DHP) | 3.6 | 2.475 | 1.125 |
| 3 | Didecyl phthalate (JAYFLEX DIDP) | 4 | 2.725 | 1.125 |
| 4 | di-iso-tridecyl phthalate (JAYFLEX DTDP) | 2.9 | 2.175 | 0.725 |
| 5 | A phthatate ester (JAYFLEX TINTM) | 4.2 | 2.7 | 1.5 |
| A | | 1.9 | 1.325 | 0.575 |

The results show that the samples of the invention, samples 1 to 5, were effective in dissolving residual fuel, the effectiveness approaching that of the commercially-available Specimen A.

What is claimed is:

1. A marine engine lubricating oil composition for a slow or medium speed diesel engine comprising a major amount of an oil of lubricating viscosity having a viscosity index (VI) no greater than 110 that contains a residual fuel content and, admixed therewith, a minor amount of at least one oil-soluble or oil-dispersible ashless organic compound having at least two adjacent, substituted carbon atoms being either part of an aromatic moiety or being connected by a double bond, each of said carbon atoms carrying an O— or O— and N- containing functional group, both functional groups being derived from a carboxy group.

2. The composition of claim 1 wherein an aromatic moiety is present and is benzene, the functional groups being in the ortho position with respect to one another.

3. The composition of claim 1 wherein the functional groups are independently ester groups.

4. The composition of claim 1 wherein the compound is a phthalate ester.

5. The composition of claim 1 wherein the TBN of the composition is from 15 to 100.

6. A method of maintaining asphaltene compounds in suspension in a lubricating oil composition used in a slow or medium speed diesel engine, said method comprising admixed with said lubricating oil composition, a minor amount of at least one oil-soluble or oil-dispersible ashless organic compound having at least two adjacent, substituted carbon atoms being either part of an aromatic moiety or being connected by a double bond, each of said carbon atoms carrying an O— or O— and N- containing functional group, both functional groups being derived from a carboxy group.

7. A method of lubricating a slow or medium speed diesel engine comprising supplying to the engine the lubricating oil composition of claim 1.

8. The composition of claim 4 wherein said phthalate ester is present in an amount greater than 2 mass %, based on the mass of the composition.

9. The composition of claim 8 wherein said phthalate ester is present in an amount greater than 4 mass %, based on the mass of the composition.

10. The composition of claim 9 wherein said phthalate ester is present in an amount greater than 5 mass %, based on the mass of the composition.

11. The method of claim 6 wherein said slow or medium speed diesel engine is a cross-head or trunk piston engine.

12. The method of claim 7 wherein said slow or medium speed diesel engine is a cross-head or trunk piston engine.

* * * * *